US006368021B1

(12) United States Patent
Strong et al.

(10) Patent No.: US 6,368,021 B1
(45) Date of Patent: Apr. 9, 2002

(54) PILE AND METHOD FOR INSTALLING SAME

(75) Inventors: Philip Anton Strong, Rome (IT); Duncan Cuthill, Aberdeen; Martin Leon Kobiela, Aberdeenshire, both of (GB)

(73) Assignee: Liberty Offshore, Ltd., Devon (GB)

( * ) Notice: Subject to any disclaimer, the term of this patent is extended or adjusted under 35 U.S.C. 154(b) by 0 days.

(21) Appl. No.: 09/311,237

(22) Filed: May 13, 1999

(30) Foreign Application Priority Data

May 16, 1998 (GB) ..... 9810441

(51) Int. Cl.[7] ..... E02D 7/24; E02D 7/28

(52) U.S. Cl. ..... 405/228; 405/232; 405/249; 405/245; 405/253; 175/171; 175/257

(58) Field of Search ..... 175/171, 107, 175/61, 257, 258, 259, 260, 393, 325; 405/232, 258, 259.1, 241, 249, 228, 239, 236, 253, 245

(56) References Cited

U.S. PATENT DOCUMENTS 1,140,303 A * 5/1915 Feder ..... 405/245
3,512,366 A * 5/1970 Turzillo ..... 405/241

(List continued on next page.)

FOREIGN PATENT DOCUMENTS

| | | | | |
|---|---|---|---|---|
| DE | 2422489 | * | 11/1975 | ..... E02D/17/144 |
| EP | 0217995 A | | 4/1987 | |
| JP | 07166785 | * | 6/1995 | ..... E21B/4/10 |

OTHER PUBLICATIONS

Patent Abstracts of Japan, vol. 017, No. 667 (M–1524), Dec. 9, 1993 & JP 05 222725 A (Marui Kiso:KK), Aug. 31, 1993.

Patent Abstracts of Japan, vol. 1999, No. 909, Jul. 30, 1999 & JP 11 107662 A (Daido Concrete Co., Ltd.), Apr. 20, 1999.

Patent Abstracts of Japan, vol. 1995, No. 509, Oct. 31, 1995 & JP 07 166785 A (Mitsubishi Materials Corp.; Others: 01), Jun. 27, 1995.

*Primary Examiner*—Thomas B. Will
*Assistant Examiner*—Alexandra K. Pechhold
(74) *Attorney, Agent, or Firm*—McDermott, Will & Emery

(57) ABSTRACT

A method of drilling and installing a pile in ground comprising the steps of providing a pile, providing a drill bit at an end of the pile rotatable relative to the pile;

engaging the ground with the drill bit, and rotating the drill bit relative to the ground and the pile generating a hole into which the pile is received.

25 Claims, 7 Drawing Sheets

U.S. PATENT DOCUMENTS 3,685,303 A * 8/1972 Turzillo ..... 405/230
3,745,776 A * 7/1973 Hubby ..... 405/222
3,786,641 A * 1/1974 Turzillo ..... 405/230
3,886,754 A * 6/1975 Turzillo ..... 405/239
3,962,879 A * 6/1976 Turzillo ..... 405/236
3,969,902 A * 7/1976 Ichise et al. ..... 405/267
4,009,582 A * 3/1977 LeCorgne ..... 405/240
4,027,490 A * 6/1977 Stade et al. ..... 175/258
4,031,972 A * 6/1977 Burg ..... 175/263
4,051,685 A * 10/1977 Jansz ..... 405/228
4,154,552 A * 5/1979 van Bilderbeek ..... 405/229
4,202,416 A * 5/1980 Blaschke et al. ..... 175/171
4,488,606 A * 12/1984 Inoue ..... 175/325
4,548,526 A * 10/1985 Bullivant ..... 405/233
4,637,758 A * 1/1987 Tamaki et al. ..... 405/232
4,790,689 A * 12/1988 Henn et al. ..... 405/240
4,793,740 A * 12/1988 Schellhorn ..... 405/232
5,111,893 A * 5/1992 Kvello-Aune ..... 175/258
5,148,875 A * 9/1992 Karlsson et al. ..... 175/259
5,168,942 A * 12/1992 Wydrinski ..... 175/258
5,186,582 A * 2/1993 Bullivant ..... 405/239
5,542,784 A * 8/1996 Gardenberg ..... 405/232
5,662,182 A * 9/1997 McLeod et al. ..... 175/258
5,704,732 A * 1/1998 Horton, III ..... 405/228
5,813,481 A * 9/1998 McLeod et al. ..... 175/259
5,919,005 A * 7/1999 Rupiper ..... 405/236
5,954,146 A * 9/1999 McLeod et al. ..... 175/257
5,957,225 A * 9/1999 Sinor ..... 175/171
6,012,874 A * 1/2000 Groneck et al. ..... 405/239

* cited by examiner

PILE AND METHOD FOR INSTALLING SAME

FIELD OF THE INVENTION

This invention relates to a pile and a method of installing a pile. More especially, but not exclusively the invention relates to piles for moorings for floating structures such as offshore oil installations and vessels.

BACKGROUND OF THE INVENTION

Known anchoring systems include driven piles, suction anchors, drag embedment anchors and vertically loaded anchors and conventional drilled piles. All have disadvantages:

Driven piles must be of heavy construction since they are hammered into the ground or seabed. They are additionally not suitable for all kinds of ground.

Suction anchors are of limited use in hard soils such as coral or compacted clay. They are expensive. After use because they are above the mud-line they must generally, be recovered which adds to the cost.

Drag embedment anchors require high pre-tensioning to ensure correct embedment. In deep water this is hard to achieve without a tenisioning device. Tensioning devices add to the complexity and cost of the operation. Additionally drag embedment anchors accept only small vertical forces.

Vertically loaded anchors are difficult to embed and require a drag force of about 50% of the ultimate load capacity. This can be hard to achieve in deep water.

Conventional drilled piles are expensive since they are time consuming to install U.S. Pat. No. 3,934,528 (Deep Oil Technology Inc.) describes an offshore tension leg platform. Lengths of drill pipe may be connected together and extend through an annular casing received in a buoyant support member. The lengths of drill pipe can be manipulated by a power swivel and winch. The string of drill pipe can be used to introduce ballast to or remove it from an anchor member on the seabed. Once the anchor is ballasted in position a pile may be installed by conventional drilling and cementing. The drill pipe, swivel and winch can be used for this.

SUMMARY OF THE INVENTION

The invention seeks to overcome or reduce the problems associated with the prior art. According to the invention there is provided a method of drilling a pile in ground comprising the steps of:

i. providing a pile, ii. providing a drill bit at an end of the pile rotatable relative to the pile;

iii. engaging the ground with the drill bit; and iv. rotating the the bit relative to the ground and the pile generating a hole into which the pile is received.

According to the invention there is further provided a pile having provided one end thereof with a drill bit rotatable relative to the pile.

The invention can be relatively quick and inexpensive to install since it can be a one trip process; drilling and insertion occur in the same process. At least some embodiments of the invention provide a pile system for example for moorings which may be drilled to its design depth without the need for pre-drilled hole or for retraction and re-insertion of the pile during installation. The pile is drilled by rotating a drilling bit relative to the ground while restraining, generally the pile as a whole from rotation. Rotary motion may be transmitted to the drill bit by rotating an elongate member received in the pile. Bearings may be provided to aid this. The elongate member may be connected to a non-recoverable drilling bit of a diameter greater than the pile for example by a drive spline. The elongate member may be conduit supplying fluid to a downhole motor Some of the components such as the elongate member and motor or turbine may be recovered following deployment. Instead of using a downhole motor the elongate member may be driven from an installation vessel for example by a rotary motor. In some embodiments of the invention the drill bit may drill a hole of greater diameter than the pile. This can be achieved using, bi-centred, jetting bits or under-reamers (or other collapsible bits) which can be retrieved Alternatively a hole of a diameter less that the pile could be drilled, allowing recovery of the bit; embedment being achieved either by relying on fluid erosion to create a diameter large enough to allow the pile to advance or by relying on applied weight to displace soft sediments. This is of particular application where it is desired to grout the pile into the hole. Grouting may be undertaken even if oversize bits are not employed. Grouting can be achieved in conventional way or by using a cement fill-up device to divert slurry into cement hoses which are directed to an annular gap. The mooring line, parts or terminations thereof can be pre-installed prior to deployment of the pile. If desired a linkage point such as a mooring line termination can be mounted on a bearing assembly allowing the linkage to swivel to align itself to applied tension thereby avoiding the need to orient the pile with respect to the anticipated load to maintain its efficiency. If desired the pile can be oriented with respect to the anticipated load. If desired the pile may comprise a nest of concentric members coupled together for example with cement. This can provide a cheap high strength pile especially where the concentric members are made from standard oil field casing. The invention may be installed in the seabed utilising a vessel without using a rigid, tubular conduit. This allows the use of a (low cost) barge rather than an (expensive) floating drilling unit. This may be achieved by suspending the pile from a flexible member such as a crane line and driving the bit by a downhole motor connected by a hose to a fluid supply on the barge. In some embodiments of the invention fins which may be fixed or movable axially are provided on the pile. They resist reaction forces attempting to rotate the pile generated by the motor and allow the pile to be drilled when suspended from a member which is not torsionally rigid such as a crane wire.

Rotation of the bit may be achieved by rotation of the elongate member using rotary transmission means of an installation vessel.

Where a downhole motor is provided means for decoupling and recoupling it in situ may be provided.

BRIEF DESCRIPTION OF THE DRAWINGS

Embodiments of the invention will be described by way of non-limiting example by reference to the accompanying figures of which.

DETAILED DESCRIPTION OF THE PREFERRED EMBODIMENTS

Figure 1:
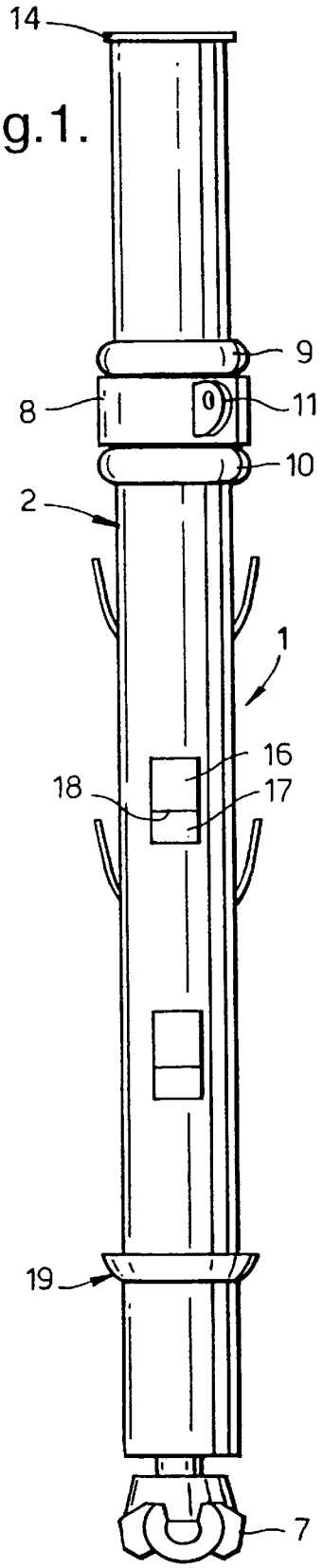
FIG. 1 is a side elevation.
Figure 2:
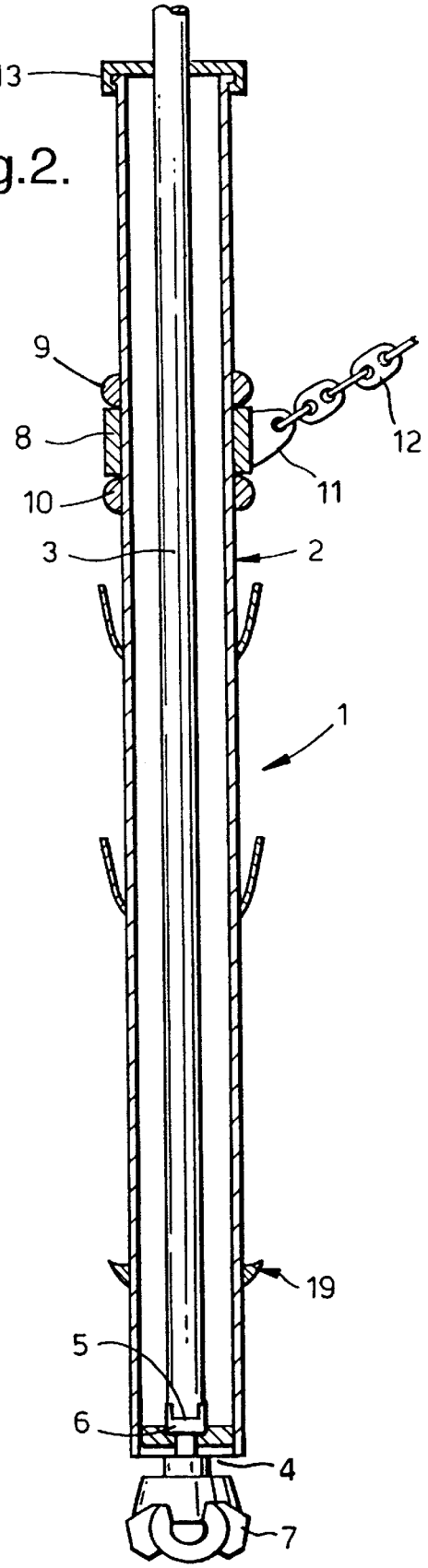
FIG. 2 is a cross-section of the embodiment of FIG. 1.

Referring first to FIGS. 1 and 2, pile 1 comprises pipe 2. Received in pipe 2 is elongate member 3. Elongate member 3 is supported in the illustrated embodiment by bearing 4. Further bearings could be provided if necessary or desired. Elongate member 3 is provided with a first drive spline 5. Drive spline 5 is coupled to a second drive spline 6 to which is connected drill bit 7. Other means of coupling could be used. Drill bit 7 may be a conventional roller bit used in drill holes. This is in fact preferred since many of the engineering problems associated with developing the bits have been solved. Furthermore suitable used bits may be available cheaply as surplus.

Drill bit 7 should be capable of drilling a hole which receives the pipe 1. The hole may be the same size or larger than the pile. It may also be smaller with the combination of the weight of the pile and the fluid flow to be described hereinafter allowing the pile to penetrate soft ground.

Where the drill bit is larger than the outside diameter of the pipe 2 it will not, generally, be possible to recover the drill bit. Where relatively cheap bits are used this is not a serious problem. In any event the cost of the bit is small relative to the cost savings resulting from not needing to drill a hole recover the bit and drilling assembly and running the pile as separate sequential operations. The savings would generally become much more significant with increases in water depth.

Means for attaching an object to the pile may be provided FIGS. 1 and 2 show a convenient swivel assembly. Ring 8 is retained for rotational movement about the pipe by collars 9, 10. Pad eye 11 is provided for mooring chain 12. Other mooring terminations could be provided.

Means 13 for engaging latch tool 14 may be provided.

Desirably means for resisting forces tending to extract the pile from the hole are provided, while preferably providing minimal resistance whilst installing the pile. In the illustrated embodiment a plurality of barbs are provided.

The barbs as illustrated are broadly rectangular. The edge nearer to the drill bit is joined for example by welding to the pipe. The edge further from the drill bit is spaced away from the pipe. Each barb comprises two generally planar portions 16, 17 joined together at fold line 18.

Figure 3:
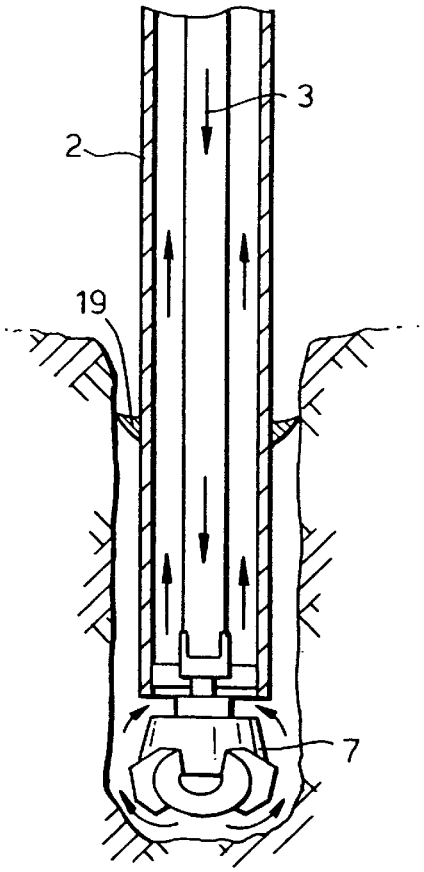
FIG. 3 is a schematic representation of a fluid path during drilling.

Desirably a sealing ring 19 for example of resilient material is provided toward the end of the pipe nearer the drill bit. As can be seen from FIG. 3 the sealing ring can be used to help divert fluid inside the pile. In FIG. 3, cutting fluid, for example "drilling mud", passes downwardly through elongate member 3. It escapes through one or more holes for example in the drill bit into bore cavity 20. The cutting fluid cools the drill bit, and washes debris away. Cutting fluid with entrained debris is restrained from escaping out of the bore cavity by the sealing ring. Much cutting fluid therefore enters the annular space defined by the pipe and elongate member via a hole or holes (not shown). It ascends the hole and may be discharged to the sea or carried via a conduit to a vessel for reconditioning for re-use for example by filtering off debris to the surface for reconditioning for example by filtering the debris off and refuse. This arrangement prevents excessive washing of the bore hole which could undermine the ultimate strength of the pile and could create problems in grouted embodiments in effectively grouting the pile to the ground formations.

Figure 4:
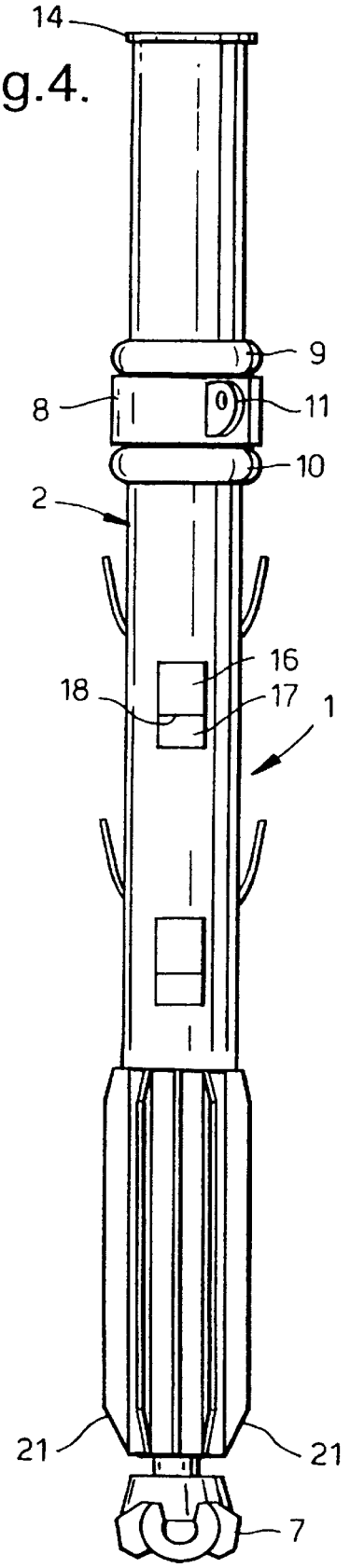
FIG. 4 is a side elevation of a further embodiment.
Figure 5:
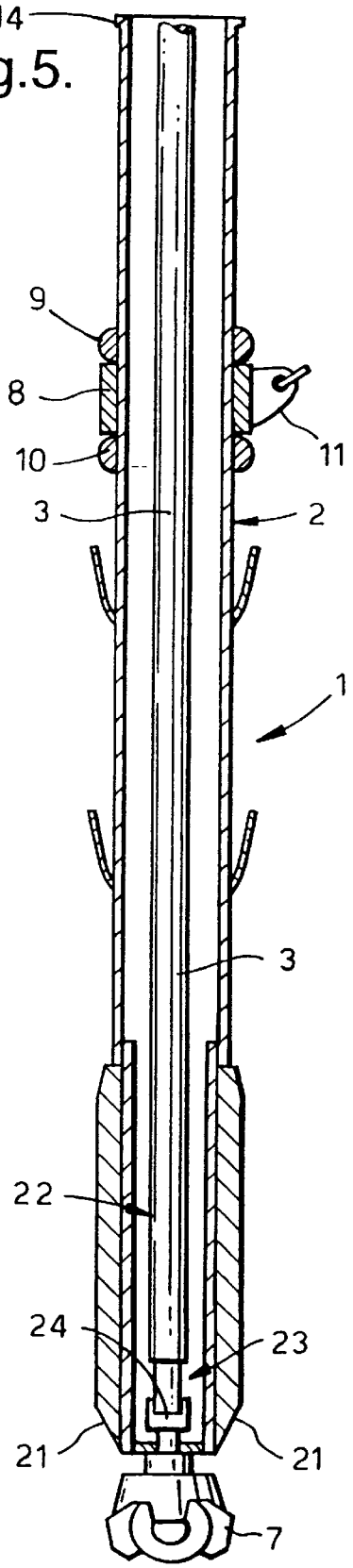
FIG. 5 is a cross section of the embodiment of FIG. 4.

FIGS. 4 and 5 show a pile broadly similar to that of FIGS. 2 and 3. At least some of the common parts are shown with the same reference numbers. There are two principle differences which may be used independently of each other. First to provide even greater reaction to rotational forces exerted on the pile a plurality of reaction splines 21 are provided towards the end of the pipe carrying the drill bit. The splines comprise radial plates. Where the pile is installed suspended from a member which is not torsionally rigid, desirably means for restricting or preventing rotation of the pile in reaction to the forces generated by the drill bit are provided. Preferably the means for preventing rotation provide little resistance to downward movement of the pile. This may comprise a plurality of reaction splines. The splines may be provided toward the bit end of the pile. The splines may comprise radial plates. In the illustrated embodiment a plurality of fins are provided. Fins present a large area restraining rotational movement but a small area resisting axial movement.

Secondly a downhole motor 22 is provided. Means for actuating the downhole motor are provided. Those skilled will have little difficulty in devising suitable means. Examples include fluid such as liquid or gas under pressure or electricity. The down hole motor 22 is provided with a drive shaft 23. Drive shaft 23 engages a drive box 24 connected to the drill bit. This arrangement is advantageous because downhole motors are reliable, and readily available and relatively cheap to hire but expensive to buy. The arrangement allows the downhole motor to be retrieved following deployment by disengaging the drive shaft from the drive box.

Figure 6:
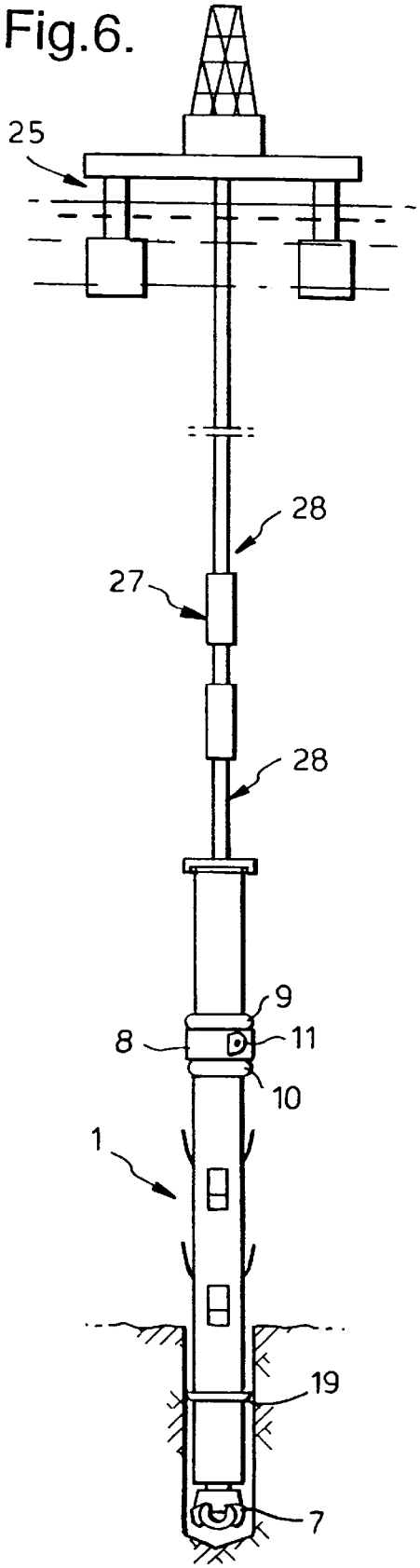
FIG. 6 is a schematic representation of the embodiment of FIG. 1 being deployed.

FIG. 6 illustrates the embodiment of FIGS. 1 to 3 being deployed by a drilling rig 25. Elongate member 26 extends upwardly from the pile via bumper sub 27, which is used to help provide a steady weight feed to the bit during the installation process. In use the drill bit is rotated as hereinbefore described. As the bore cavity is generated the pile sinks into the ground until it is at the required depth. Elongate member 26 is removed and the pile is ready for use. In some cases it may be desirable to grout the pile to the ground. Those skilled in the art will have no difficulty in devising suitable method for example using fluid divertor subs.

Figure 7:
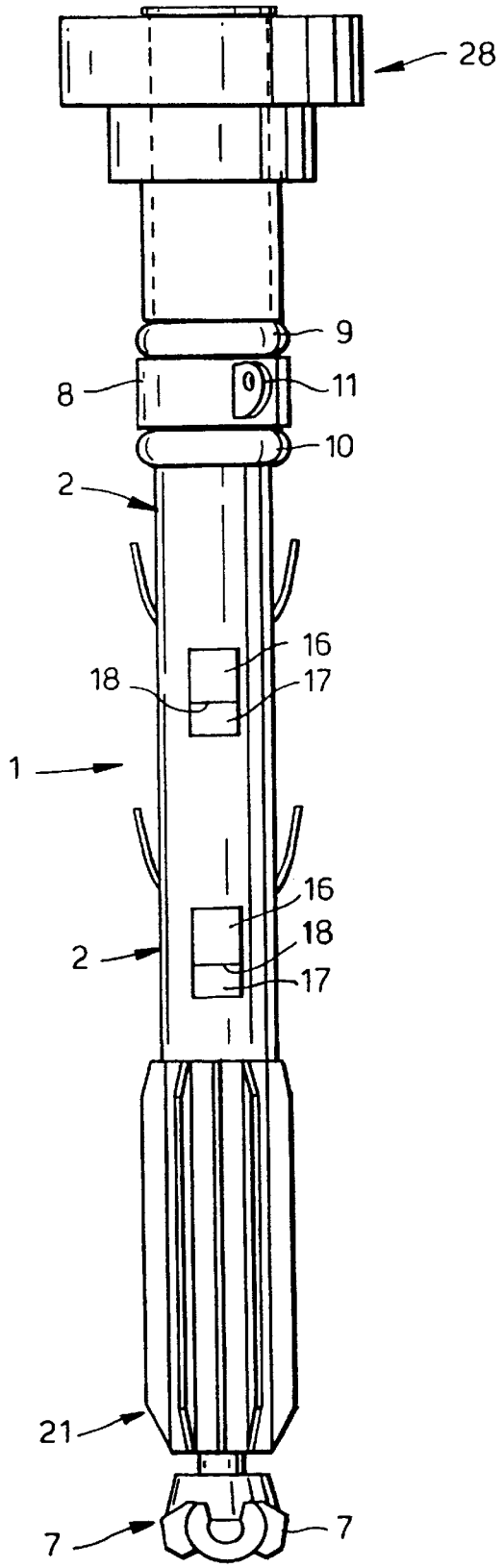
FIG. 7 is a side elevation of a still further embodiment.
Figure 8:
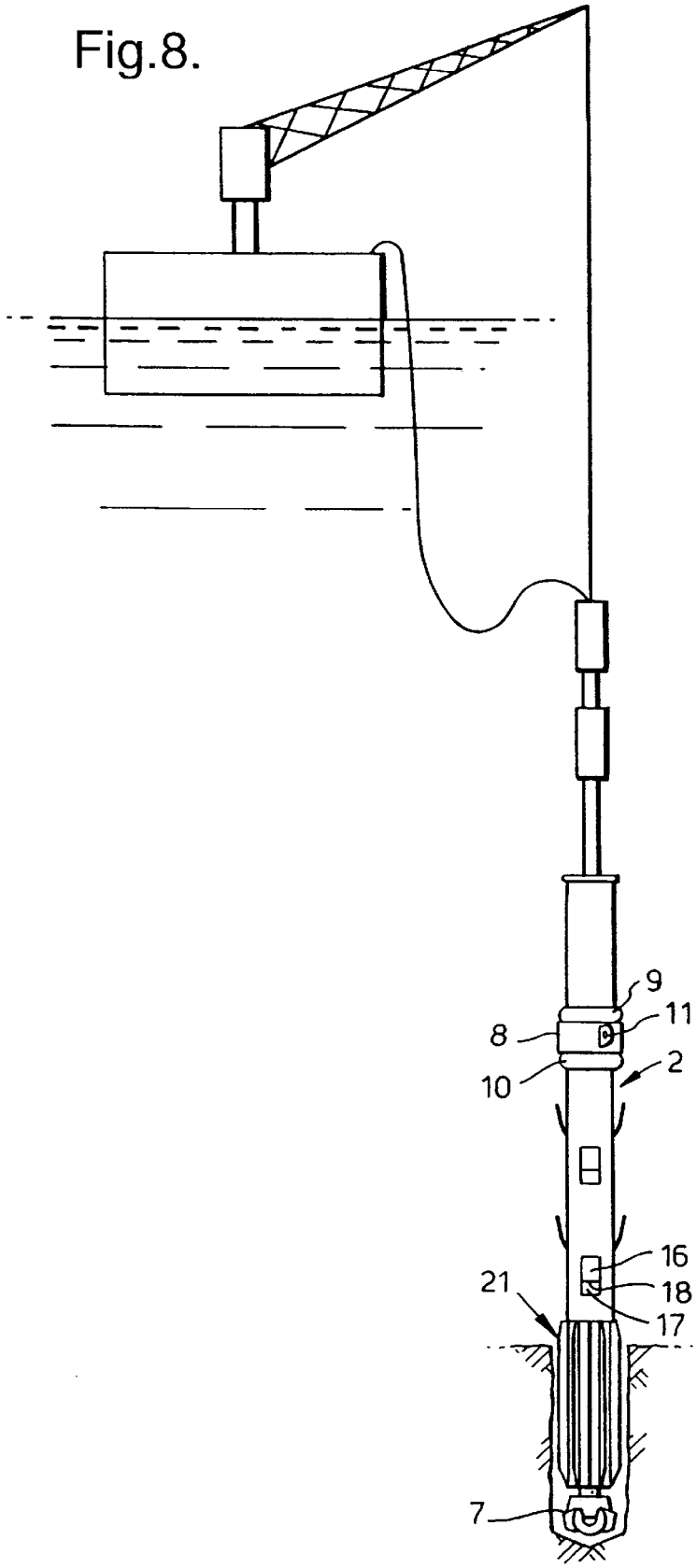
FIG. 8 is a schematic representation of the embodiment of FIGS. 4, 5 and 7 being deployed from a barge.
Figure 9:
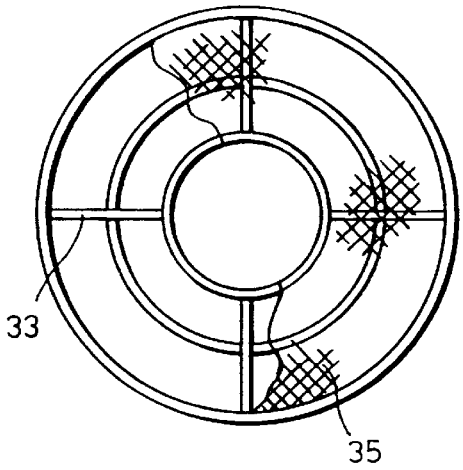
FIG. 9 is a partially cutaway plan view of a member for use in some embodiments of the invention.
Figure 10:
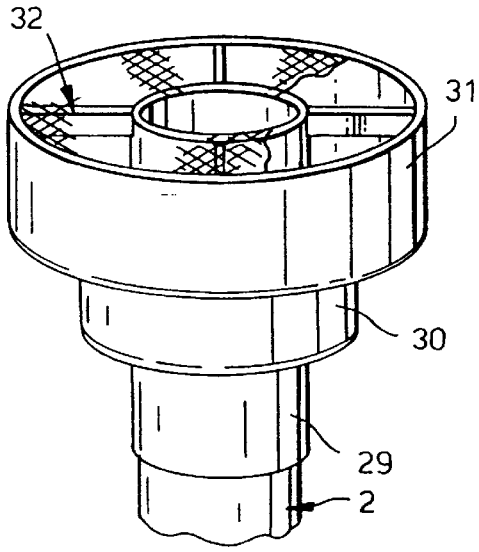
FIG. 10 is a partially cutaway perspective view of the member of FIG. 9.
Figure 11:
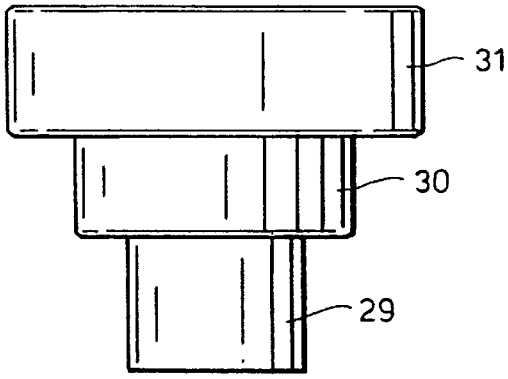
FIG. 11 is a side elevation of the member of FIG. 9.
Figure 12:
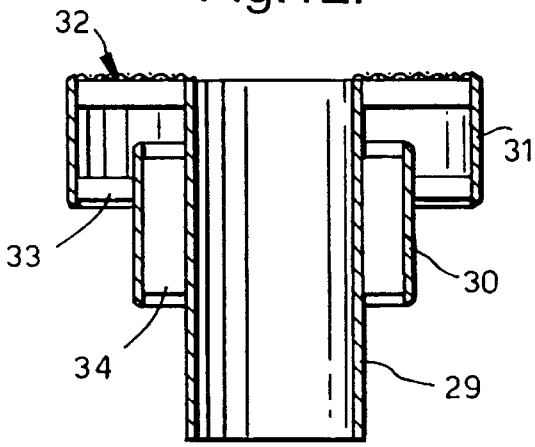
FIG. 12 is a cross section of the member of FIG. 9.

FIG. 7 illustrates an additional, deflection reaction, member for use with any of the piles described herein. It is illustrated in more detail in FIGS. 9 to 12. The additional member is intended to increase the forces which the pile can withstand. It may be fitted following deployment of the pile or may be fitted to the pile before deployment. Deflection assembly 28 comprises a plurality of nested rings 29, 30, 31. Inner ring 29 engages the pile while intermediate soil reaction ring 30 and outer soil reaction ring 31 are spaced apart from it. In a typical 50 cm (20 in) diameter pile the outer soil reaction ring 31 may have a diameter of about 3 m. The depth of the inner ring 29 is greater than that of the intermediate soil ring which is deeper an the outer soil ring. The rings are joined by axial ribs 32, 33, 34. A grating 35 providing extra strength extends over the top surface of the deflection assembly leaving a central hole. The deflection reaction member may be fitted after drilling of the pile.

Figure 13:
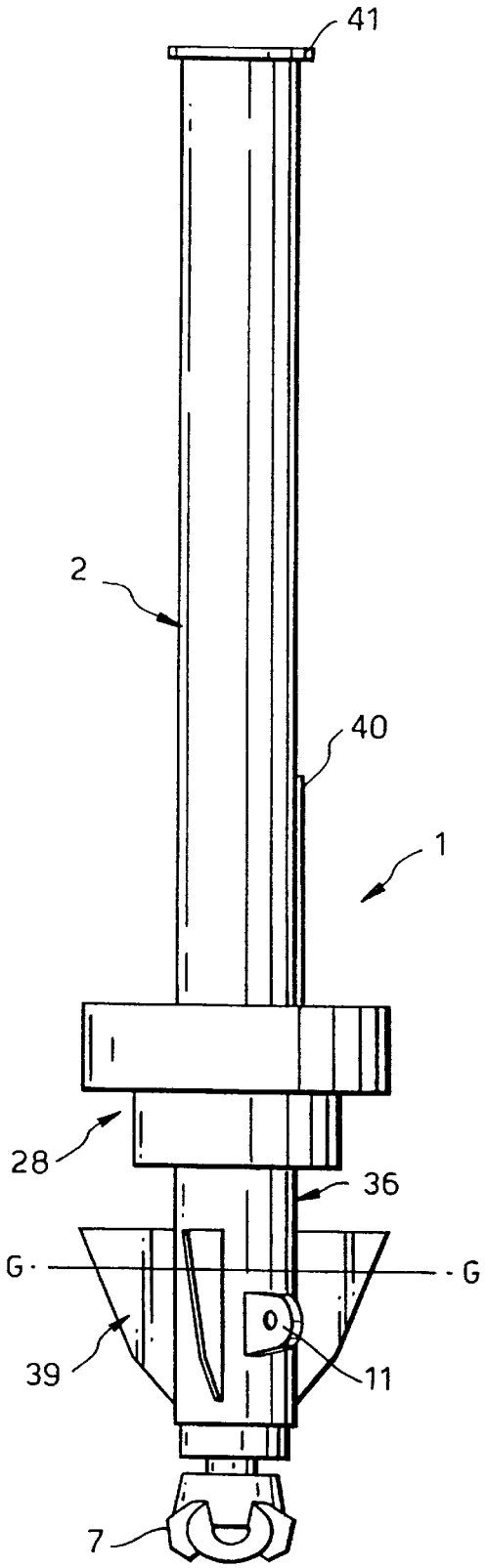
FIG. 13 is a side elevation of a yet further embodiment in a first configuration.
Figure 14:
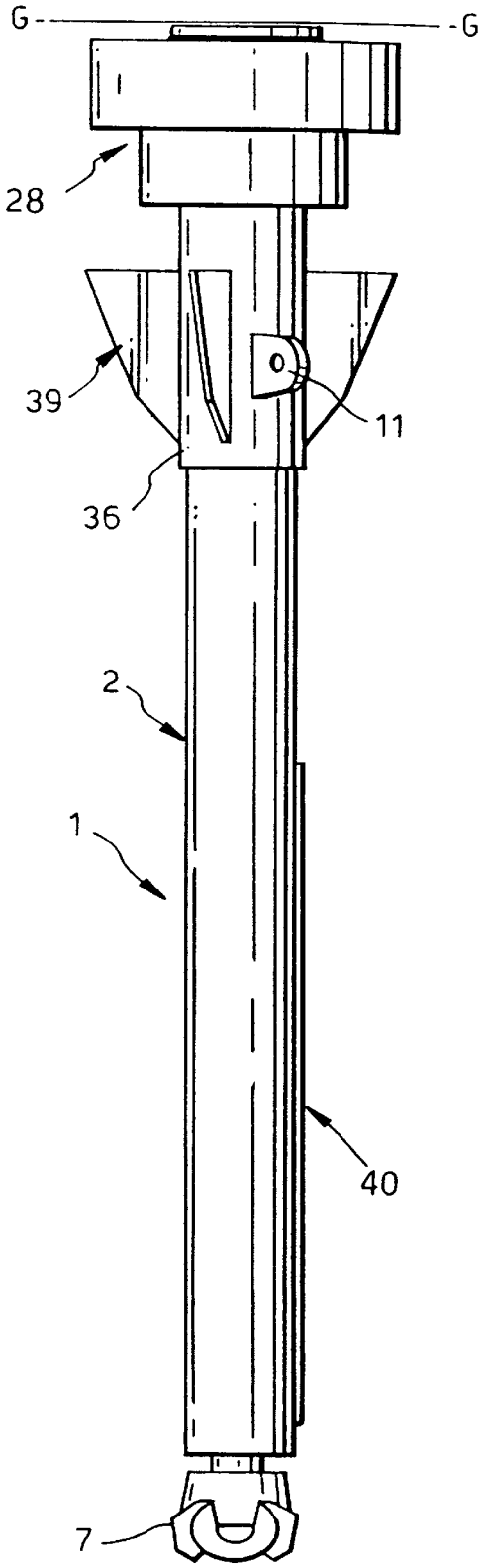
FIG. 14 is a side elevation of the embodiment of FIG. 13 in a second configuration.

FIGS. 13 and 14 illustrate a yet further embodiment. Once again similar numbered parts have similar functions. As illustrated there are two different features which can be used separately or together. Means for resisting rotational forces are provided axially movable relative to the pile. In the illustrated embodiment this comprises both a deflection assembly 28 and fins to be described in greater detail hereinafter. It will be apparent that the deflection assembly or the fins could be omitted or fixed relative to the pile.

Sleeve 36 carries a plurality of quadrilateral fins 39 and a mooring termination. It is also provided with a deflection assembly 28. One of the sleeve 36 and pipe 2 is provided with a key 40 for engagement with a keyway of the other. In the illustrated embodiment the pipe has the key but the reverse arrangement could be employed. More than one key and key way could be provided. Alternatively other means for transferring rotational drive forces while allowing relative axial movement could be used. The key prevents rotation of the pipe relative to the sleeve but does not prevent axial movement. An initial configuration is shown in FIG. 13. The tip of the pipe has penetrated the ground G—G with the fins 39 partially engaged. The drill can be actuated. Rotation of the pile is inhibited by the fins. As the drill drills a hole the pipe descends. The sleeve may also descend but it does not descend as far as the pile but moves axially relative to the pile guided by the key way or splines. At some point the sleeve may slide beyond the end of the key way. The pipe may then become movable relative to the sleeve. At the end of its travel the sleeve 36 may engage end stop 41. Further drilling will allow the sleeve to move in conjunction with the pile. Drilling may continue with this as well as the other embodiments until the end of the pile is flush with or under the surface of the ground. This is desirable since at the end of the useful life it may be possible to simply abandon the pile rather than attempt to recover it. This can be preferred since the pile can be made of relatively low cost components.

If desired the invention can be made de novo by methods apparent to the skilled worker from new materials. However it may be preferred on cost grounds to adopt materials originally intended for or used in other applications. In particular the pipe 2 can be made from drill casing which may be available on the surplus market.

The invention in at least some embodiment allows a pile to be installed by drilling more rapidly than is generally possible with a driven pile or a suction pumped pile.

The invention allows in at least some embodiment a pile to be installed in a wide range of soils which is not easily achievable with a driven or suction pumped pile.

At least some embodiments of the invention provide a high strength pile capable of withstanding high lateral and vertical loads such as those generated by deep water mooring systems.

At least some embodiments of the invention can be used as anchoring points for taut leg mooring systems providing a high vertical load capability using tubular casings of lesser diameter than required for comparable suction anchors in view of the deep embodiment achievable in any soil.

A single pile design can be used in a wide range of soil conditions reducing the need for accurate assessment, for example by site survey of soil conditions.

While the invention has been described by reference to subsea applications the invention is not so restricted and may be used on land.

What is claimed is:

1. A method of installing a pile into ground underwater to create a mooring, anchorage, comprising:

i. providing a hollow pile and an elongate hollow member extending within the pile;

ii. supporting a drill bit at an end of the elongate member and exteriorly of the hollow pile by means of a bearing assembly mounted within the hollow pile adjacent the drill bit;

iii. utilizing fluid drive means to impart rotary motion only to the drill bit relative to the pile, via the bearing assembly, while engaging the drill bit with the ground underwater to produce a hole into which the pile is sunk;

iv. establishing a fluid diverter on an exterior surface of the pile and extending outwardly from the exterior surface to engage on the surrounding wall surface of the hole to restrict the flow of fluid between the exterior surface of the pile and the wall surface and v. causing fluid to flow in a path extending downwardly, through the elongate member around the drill bit and then predominantly upwardly between the interior of the pile and the exterior of the elongate member.

2. A method according to claim 1, wherein the fluid drive means is a fluid drove motor removably disposed within the pile to drive the rotatable member.

3. A method according to claim 2 and further comprising providing a mooring connection on the exterior of the pile, withdrawing the drive motor, the elongate member and the drill bit from the pile and attaching a mooring termination to the mooring connection on the pile.

4. A method according to claim 1 and further comprising attaching a deflection load resisting assembly to an upper end of the pile said assembly being of greater diameter than the pile and serving to contact the ground after the pile has been installed to enhance the ability of the mooring anchorage to cope with lateral loading.

5. A method according to claim 1, wherein the fluid assists the drill bit in producing the hole.

6. A method according to claim 1, wherein the fluid diverter is resilient.

7. A method according to claim 1, wherein the fluid drives the drive means and assists the drill bit in producing the hole.

8. A method of installing a pile into ground underwater to create a mooring anchorage, comprising:

i. providing a hollow pile and a hollow member extending within the pile;

ii. passing fluid downwardly through the hollow member to produce a hole in the ground into which the pile is progressively sunk;

iii. establishing a fluid diverter on an exterior surface of the pile and extending outwardly from the exterior surface to engage the surrounding wall surface of the hole to restrict the flow of fluid between the exterior surface of the pile and the wall surface and iv. causing the fluid to flow in a return path extending predominantly upwardly between the interior of the pile and the exterior of the rotatable member for escape.

9. A method according to claim 8 and further comprising utilizing means on the exterior of the pile to restrain the pile against upward movement in the hole away from the ground.

10. A method according to claim 8, wherein the fluid diverter is resilient.

11. A method according to claim 8 and further comprising attaching a deflection load resisting assembly to an upper end of the pile said assembly being of greater diameter than the pile and serving to contact the ground after the pile has been installed to enhance the ability of the mooring anchorage to cope with lateral loading.

12. Apparatus for providing a mooring anchorage in ground underwater, comprising:

i. a hollow pile with first and second ends disposed in a hole in the ground underwater;

ii. a hollow member extending within the hollow pile;

iii. fluid diverting means located on the exterior surface of the pile in the vicinity of the first end, the fluid diverting means projecting outwardly from the exterior surface of the pile to engages with the wall surface of the hole and cooperates with the pile and the hollow member to define a flow path extending downwardly through the interior of the member and then upwards between the interior of the pile and the exterior of the rotatable member to permit escape of the fluid whereby the passage of the fluid produces the hole into which the pile is progressively sunk.

13. Apparatus according to claim 12 and further comprising means on the exterior of the pile which serves to engage with the wall surface of the hole and restrains the pile from upward vertical extraction displacement away from the ground.

14. Apparatus according to claim 12 and further comprising a rotatable mooring connection located on the exterior surface of the pile in the vicinity of the second end, the rotatable mooring connection having an eye disposed laterally of the pile to which a mooring termination is attachable.

15. Apparatus according to claim 12, wherein the fluid diverting means is resilient.

16. Apparatus according to claim 12 and further comprising a deflection load bearing assembly attached to the second end of the pile, said assembly being of greater diameter than the pile to contact the ground after the pile has been installed to enhance the ability of the mooring anchorage to cope with lateral loading.

17. Apparatus for providing a mooring anchorage, comprising:

i. a hollow pile with first and second ends;

ii. a hollow member extending within the hollow pile;

iii. a drill bit supported by the hollow member adjacent the first end of the pile and extending outwardly of the pile by means of a bearing assembly mounted within the first end of the pile adjacent the drill bit;

iv. fluid drive means for imparting rotary motion only to the drill bit, via the bearing assembly, the drill bit being driven by the drive means to engage an underwater ground surface beneath the first end of the pile to produce a hole into which the pile is sunk and v. fluid diverting means located on the exterior surface of the pile in the vicinity of the first end, the fluid diverting means projecting outwardly from the exterior surface of the pile to engage with the wall surface of the bore and cooperate with the pile and the hollow member to define a flow path extending downwardly through the interior of the member around the drill bit and then upwards between the interior of the pile and the exterior of the rotatable member.

18. Apparatus according to claim 17, wherein the fluid diverting means is resilient.

19. Apparatus according to claim 17, wherein the hollow member is non-rotatable and releasable coupling means are provided for drivably coupling the drill bit and the fluid drive means.

20. Apparatus according to claim 17 and further comprising a deflection load bearing assembly attached to the second end of the pile, said assembly being of greater diameter than the pile to contact the ground after the pile has been installed to enhance the ability of the mooring anchorage to cope with lateral loading.

21. A method of installing a pile into ground underwater to create a mooring anchorage, comprising:

i. providing a hollow pile;

ii. providing a hollow member with a drive motor within the pile;

iii. supporting a drill bit at the end of the hollow member and exteriorly of the hollow pile by means of a bearing assembly mounted within the hollow pile adjacent the drill bit;

iv. imparting rotary drive only with the drive motor to drive the drill bit, via the bearing assembly, relative to the pile while engaging the drill bit with the ground underwater to produce a hole into which the pile is sunk;

v. establishing a fluid diverter on an exterior surface of the pile and extending outwardly from the exterior surface to engage the surrounding wall surface of the hole to restrict the flow of fluid between the exterior surface of the pile and the wall surface and vi. causing fluid to flow in a path extending downwardly through the rotatable member around the drill bit and then predominantly upwardly between the interior of the pile and the exterior of the rotatable member for escape.

22. A method according to claim 21 and further comprising attaching a deflection load resisting assembly to an upper end of the pile said assembly being of greater diameter than the pile and serving to contact the ground after the pile has been installed to enhance the ability of the mooring anchorage to cope with lateral loading.

23. A method according to claim 21, wherein at least part of the elongate member and the drive motor are detachably coupled to the drill bit and the method further comprises detaching and removing the drive motor and said part of the elongate member once the pile has been installed.

24. A method of installing a pile into the ground underwater to create a mooring anchorage, comprising:

i. providing a hollow pile and an elongate member extending within the pile;

ii. supporting a drill bit at an end of the elongate member and exteriorly of the hollow pile by means of a bearing assembly mounted within the hollow pile adjacent the drill bit;

iii. providing a mooring connection rotatably mounted on the exterior of the pile in a pre-determined location remote from the drill bit, the mooring connection having an opening disposed laterally of the pile for receiving a mooring termination;

iv. utilizing drive means to impart rotary motion only to the drill bit, via the bearing assembly, relative to the pile while engaging the drill bit with the ground underwater to produce a hole into which the pile is sunk; and v. establishing a fluid diverter between the exterior of the pile and the surrounding wall surface of the hole and causing fluid to flow in a path extending downwardly through the elongate member around the drill bit and predominantly upwardly between the interior of the pile and the exterior of the elongate member.

25. Apparatus for providing a mooring anchorage, comprising:

i. a hollow pile with first and second ends;

ii. an elongate member extending with the hollow pile;

iii. a drill bit supported by the elongate member adjacent a first end of the pile and exteriorly of the pile, by means of a bearing assembly mounted within the first end of the hollow pile adjacent the drill bit, the drill bit being driven by drive means to rotate only relative to the pile via the bearing assembly and to engage an underwater ground surface beneath the first end of the pile to produce a hole into which the pile is sunk;

iv. a mooring connection rotatably mounted on the exterior of the pile in the vicinity of the second end, the mooring connection having an opening for receiving a mooring termination; and v. fluid diverting means on the exterior of the pile which engages with the wall surface of the bore and cooperates with the pile and the hollow member to define a flow path extending downwardly through the interior of the member around the drill bit and then upwards between the interior of the pile and the exterior of the rotatable member.

* * * * *